United States Patent [19]

Zimmerman et al.

[11] Patent Number: 4,463,687

[45] Date of Patent: Aug. 7, 1984

[54] POWERED DOWNDRAFT GASIFIER

[75] Inventors: Valentine Zimmerman, Galesville; Stephen J. Mrachek, Trempealeau, both of Wis.

[73] Assignee: E. K. Industries, Inc., Galesville, Wis.

[21] Appl. No.: 369,666

[22] Filed: Apr. 19, 1982

[51] Int. Cl.[3] ..... F23B 7/00

[52] U.S. Cl. ..... 110/233; 110/108; 110/214; 110/293; 110/302; 110/336; 122/20 B

[58] Field of Search ..... 110/102, 108, 210, 214, 110/229, 256, 234, 235; 122/20 B

[56] References Cited

U.S. PATENT DOCUMENTS

| | | | |
|---|---|---|---|
| 843,105 | 2/1907 | Roell | 126/76 |
| 1,668,585 | 5/1928 | Custer | 126/76 |
| 1,717,657 | 6/1929 | Box | 126/76 |
| 4,080,909 | 3/1978 | Nalbandian et al. | 110/235 |
| 4,102,187 | 7/1978 | Runquist | 126/103 |
| 4,182,304 | 1/1980 | Mele | 126/76 |
| 4,254,715 | 3/1981 | LaHaye et al. | 110/214 |
| 4,334,484 | 6/1982 | Payne et al. | 110/210 |
| 4,356,778 | 11/1982 | McRee, Jr. | 110/234 |
| 4,366,802 | 1/1983 | Goodine | 110/108 |

FOREIGN PATENT DOCUMENTS

| | | | |
|---|---|---|---|
| 54-147669 | 11/1979 | Japan | 110/210 |

*Primary Examiner*—Edward G. Favors
*Assistant Examiner*—Steven E. Warner
*Attorney, Agent, or Firm*—Sixbey, Friedman & Leedom

[57] ABSTRACT

A powered downdraft type combustion unit which substantially completely gasifies the fuel burned therein during the combustion process and produces a maximum amount of usable heat for utilization at a location remote from the combustion unit is provided. The present combustion unit includes a heavily insulated outer shroud enclosing insulated sequential combustion chambers to prevent heat loss from the combustion chambers. A primary combustion chamber is separated from a secondary combustion chamber by a plurality of refractory grates. Fuel is fed to the primary combustion chamber to be combusted therein, and the products of this stage of combustion then pass to the secondary combustion chamber where the combustion process is completed. The heat-containing combustion gases are directed from the secondary combustion chamber to a heat utilizing appliance through a conduit connected therebetween. Sufficient oxygen to assure complete combustion is provided by multiple air inlets in both combustion chambers and draft inducing means which assures the maintenance of a positive flow of air through the unit. In a preferred embodiment of the present invention the fuel feed into the primary combustion chamber is sealed, and the primary and secondary combustion chambers are all positioned in the same horizontal plane so that the cross-flow of air and combustion gases is achieved through the unit. The present combustion unit efficiently burns low quality fuels to produce a maximum amount of heat which may be utilized for many purposes.

7 Claims, 5 Drawing Figures

POWERED DOWNDRAFT GASIFIER

TECHNICAL FIELD

The present invention relates generally to heat producing combustion units and in particular to a powered downdraft combustion unit wherein the fuel is gasified and the usable heat thus produced is maximized.

BACKGROUND ART

Because of the ever increasing costs of energy, home heating costs, particularly in those parts of the country which experience cold winters, have risen astronomically. In addition, agricultural and industrial processes which require heat have become almost prohibitively expensive, especially for the small processor. Available heat-producing combustion units are either inefficient and do not yield a high percentage of usable heat or require expensive fuels such as oil to function efficiently. The most efficient units available are those which effect essentially complete combustion of the fuel, such as the stoves and furnaces disclosed in U.S. Pat. Nos. 843,105 to Roell, 1,668,585 to Custer, 1,717,657 to Box, 4,102,318 to Runquist and 4,182,304 to Mele. Ideally, the fuel is completely burned to produce only gaseous products of combustion, such as carbon dioxide, without the production of smoke. This requires a constant supply of oxygen to the combustion site. While many of the units disclosed in the aforementioned U.S. patents have made great strides toward completely gasifying the products of combustion, nonetheless, they continue to suffer from some significant disadvantages, especially when complete gasification of the combustion products is required so that the heat energy associated with these products can be used efficiently some distance from the combustion unit. In particular, all of the units disclosed in the aformentioned patents radiate a significant amount of heat into the immediate vicinity of the stove or furnace. Additionally, the heat loss around the burning chamber and the fuel feed opening experienced by prior art units considerably reduces the quantity of heat available for utilization downstream of the furnace or stove.

Moreover, although the prior art, specifically Mele in U.S. Pat. No. 4,182,304, discloses a combustion unit which burns a solid carbonaceous fuel like wood or coal more efficiently than earlier units, this increased efficiency is not necessarily realized with other solid biomass fuels, such as, for example, corn cobs or wood chips. Additionally, the Mele unit is intended to radiate sufficient heat to heat a given interior space to a comfortable temperature. Therefore, the combustion gases leaving the unit possess very little heat. In fact, since the sole function of the Mele unit, as well as that of the majority of the units disclosed in the U.S. patents cited hereinabove, is to radiate heat to the space around the unit, the combustion gases and products of combustion should ideally not possess any heat.

Consequently, a need exists for combustion unit which will efficiently burn a variety of solid biomass fuels, particularly those of low quality, so that complete combustion and gasification of these fuels takes place and a maximum amount of the heat produced by such combustion is made available for utilization in applications significantly downstream of the unit.

DISCLOSURE OF THE INVENTION

It is, therefore, a primary object of the present invention to provide a combustion unit which efficiently and completely burns solid biomass fuels to produce combustion gases containing a maximum quantity of usable heat.

It is another object of the present invention to produce a combustion unit wherein heat loss from the unit by radiation is virtually eliminated.

It is yet another object of the present invention to provide a combustion unit of the downdraft type having sequential combustion chambers which substantially completely gasifies the fuel during the combustion process to produce, without the production of smoke, only gaseous products which may be efficiently utilized at a location away from the unit.

It is still another object of the present invention to provide a combustion unit of the downdraft type including draft inducing means to maximize the production of heat-containing combustion gases from solid biomass fuels.

Further objects and advantages will be apparent to those skilled in the art from a review of the following description and claims and the accompanying drawings.

In accordance with the aforesaid objects, the present invention provides a combustion unit of the downdraft type including sequential combustion chambers defined within a heavily insulated shroud. The primary combustion chamber is separated from the secondary combustion chamber by a plurality of refractory grates. A fuel feed hopper communicates with the primary combustion chamber to provide fuel for the combustion process. A plurality of airinlets in both the primary and the secondary combustion chambers provides sufficient oxygen to assure complete combustion. The flow of hot gases and products of combustion is directed through a conduit from the secondary combustion chamber to a heat utilizing structure where the heat of the combustion gases may be used prior to exiting the chimney. Suitable structures for this purpose include air to air heat exchangers, boilers, tubing with reflectors to provide radiant heat to a building, grain roasters and dryers and the like. Draft inducing means are included in the conduit and may be posiioned within the conduit between the secondary combustion chamber and the heat utilizing structure or between the heat utilizing structure and the chimney for the purpose of maintaining a positive flow of air through the unit, thus further assuring the presence of adequate oxygen to achieve complete combustion. The heavily insulated shroud which encases the entire combustion unit and the insulated primary and secondary combustion chambers prevents heat loss from the unit by radiation and maximizes the heat retained by the combustion gases. In one embodiment the fuel feed hopper is tightly sealed to produce a pattern of air circulation which is essentially horizontal so that air flows across the grates from the primary to the secondary combustion chamber. Another embodiment provides an open fuel hopper for automatic feeding and to permit the air flow to follow a generally vertical path from the top of the unit downward through the grates.

BEST MODE FOR CARRYING OUT THE INVENTION

As used herein, the term "combustion unit" refers to a device, such as a stove or furnace or the like, in which a fuel is burned or combusted to provide gaseous combustion products, smoke and ash. The combustion unit of the present invention is designed to combust the fuel completely so that virtually no smoke is produced and the gaseous combustion products possess a maximum amount of the heat energy produced by the combustion process.

Figure 1:
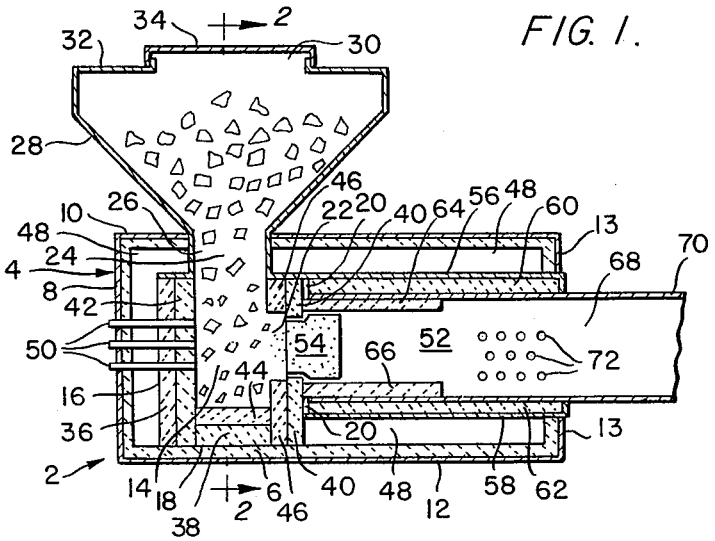
FIG. 1 is a cross-sectional view of one embodiment of the combustion unit of the present invention.
Figure 2:
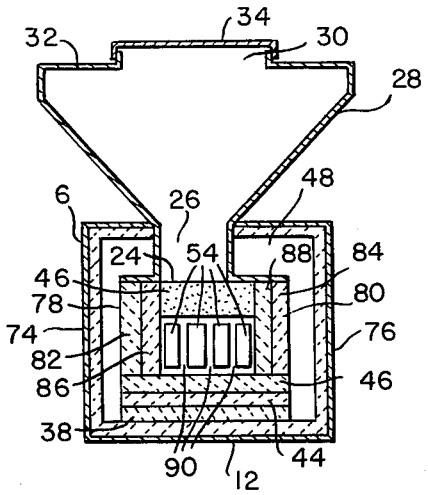
FIG. 2 is a cross-sectional view of the embodiment of FIG. 1 taken along lines 2—2 of FIG. 1.

Referring to the drawings, FIG. 1 illustrates a first embodiment of the present invention. The entire unit is tightly sealed and carefully insulated for the purpose of minimizing the amount of heat lost by radiation from the unit itself. A maximum amount of usable heat is thus retained by the gaseous products of combustion. The combustion unit 2 of the present invention includes an outer shroud 4 generally having the configuration of a rectangular solid or right angle parallelepiped which completely encases the interior structures of the unit. A layer of insulating material 6 is positioned just inside the shroud to form a lining having the same general configuration as the shroud. The shroud includes side walls, a front wall 8, a top wall 10, a bottom wall 12 and back wall sections 13, which are shown in FIG. 1. The side walls of the shroud are shown in FIG. 2. Disposed within the shroud and spaced inwardly from the shroud front wall 8 and top wall 10 is one of two sequential combustion chambers, a primary combustion chamber 14. The primary combustion chamber 14 is defined by a front wall 16, a bottom wall 18 and a back wall 20 which includes therein a chamber outlet 22. Positioned in the primary combustion chamber 14 where a top wall would normally be is the primary combustion chamber inlet 24. A fuel feed conduit 26 connects a fuel storage hopper 28 with the primary combustion chamber, and a fuel feed opening 30 in the top 32 of fuel storage hopper 28 is tightly sealed by a removable lid 34. Fuel storage hopper 28 is normally maintained in a tightly sealed condition during operation of the combustion unit, and is preferably sufficiently large to store enough fuel to keep the unit going for many hours. Because of the efficiency of the instant unit, combustion may be achieved with less fuel than is required for prior art units. Although the funnel shaped fuel storage hopper shown has been found to function efficiently with the present combustion unit, other hopper shapes are contemplated to be within the scope of the present invention.

Parallel to and immediately adjacent the interior of the walls of the primary combustion chamber are two layers of insulating material. Outer insulation layer 36 in lines chamber front wall 16, layer outer 39 lines chamber bottom wall 18 and outer layer 40 lines chamber back wall 20. The inner layer is preferably formed of refractory material and arranged such that inner refractory layer 42 is interior to outer insulating layer 36, inner refractory layer 44 is interior to outer insulating layer 38, and inner refractory layer 46 is interior to outer insulating layer 40. The effect of these multiple layers of insulation around the primary combustion chamber in combination with the insulated outer shroud and the additional insulation, provided by an air space 48 created by spacing the combustion chambers inwardly from the insulated shroud is to concentrate the heat produced by the combustion process within the combustion chamber and to prevent all but the most minimal quantity of heat from escaping to the outside.

As previously mentioned hereinabove in connection with the background art, an adequate supply of oxygen is required to assure complete combustion of the fuel. Air is supplied to the primary combustion chamber 14 by a plurality of primary air inlets 50 in the form of conduits positioned to extend through the shroud front wall 18, shroud insulation 6, air space 48, primary combustion chamber wall 18 and chamber front insulating layers 36 and 42 so that air outside the unit can readily reach the interior of the primary combustion chamber. The number of air inlets provided will depend on the size of the unit.

Although not shown in FIG. 1, it will usually be desirable to provide a clean-out access to the primary combustion chamber to facilitate the removal of ash.

Disposed within the outer shroud 4 and spaced inwardly from shroud top wall 10 and shroud bottom wall 12 and positioned immediately behind the primary combustion chamber is a secondary combustion chamber 52. The secondary combustion chamber 52 is separated from the primary combustion chamber 14 by several refractory grates 54 disposed within the primary combustion chamber outlet 22. The front wall of secondary combustion chamber 52 is coextensive with the back wall 20 of the primary combustion chamber; such secondary combustion chamber being further defined by a top wall 56 and a bottom wall 58. An outer layer of insulation 60 lines the top wall 56, and an outer layer of insulation 62 lines the bottom wall 58 to prevent heat transfer from secondary chamber 52 to the outside of the unit. Additional inner insulating layers of refractory material 64 and 66 are positioned interior to insulation layers 60 and 62, respectively. Although shown terminating short of the length of the secondary combustion chamber, refractory layers 64 and 66 could extend any desired length. The secondary combustion chamber further includes a secondary combustion chamber outlet 68 disposed between shroud back wall sections 13 and connected to a combustion gas conduit 70 which directs the hot combustion gases produced by the present combustion unit to a desired end application as will be described in more detail hereinbelow. A plurality of secondary air inlets 72 provides the additional air to the secondary combustion chamber required to achieve complete combustion without the formation of smoke. Secondary air inlets 72 are preferably in the form of conduits which extend between the interior of the secondary combustion chamber and the exterior of the outer shroud. The number and precise position of these inlets will depend in large measure upon the size of the unit.

FIG. 2 illustrates the present combustion unit from the front as it would appear in cross-section. From this perspective, shroud side walls 74 and 76 and primary combustion chamber side walls 78 and 80 can be seen. Outer insulation layers 82 and 84 and inner refractory layers 86 and 88 line primary chamber side walls 78 and 80, respectively. Refractory grates 54, which are separated by spaces 90, can be more clearly seen in FIG. 2.

As will be explained in more detail hereinbelow, the present combustion unit includes draft inducing means to assure the maintenance of a constant positive flow of air through the combustion unit. It will be noted from FIG. 1 that the primary air inlets, the main body of the primary combustion chamber, the primary combustion chamber outlet, the refractory grates, the main body of the secondary combusion chamber, the secondary air inlets, and the secondary combustion chamber outlet are all in the same plane, which is substantially parallel to the longest dimension of the unit. This permits the formation of a current of air along this plane which flows generally across the unit from front to back to assure the presence of an adequate supply of oxygen for complete combustion.

Figure 3:
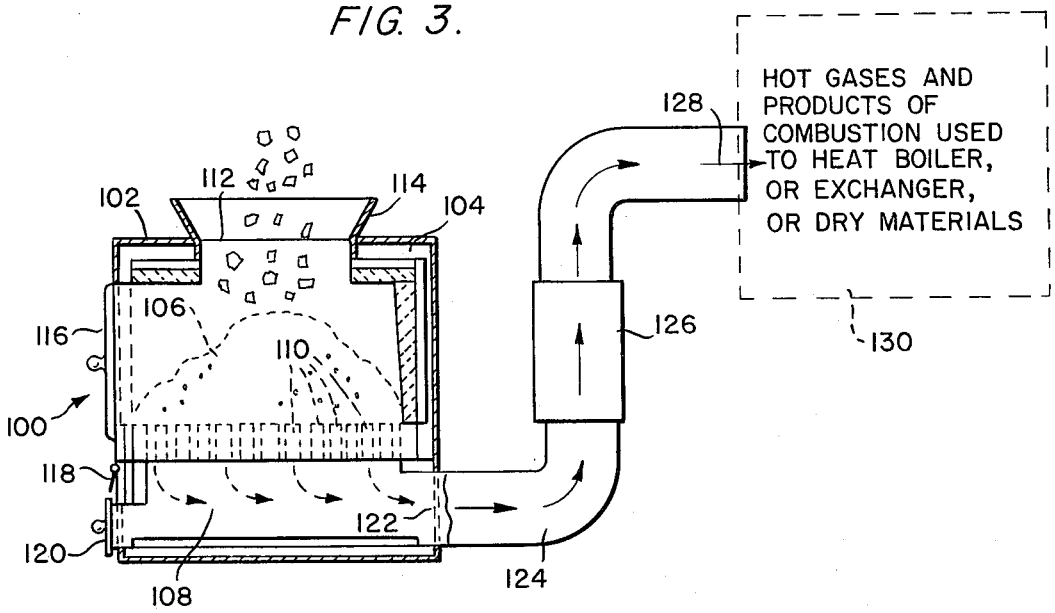
FIG. 3 is a side cross-sectional view of a second embodiment of the combustion unit of the present invention.

FIG. 3 illustrates a second embodiment of the combustion unit of the present invention which differs from the embodiment of FIG. 1 primarily in the orientation of the flow of air through the unit and the position of the secondary combustion chamber relative to the primary chamber. As in the embodiment shown in FIG. 1, the combustion unit of this embodiment 100 includes an outer shroud 102 with a layer of insulation 104 just inside the shroud walls. The shroud encloses completely a primary combustion chamber 106 positioned directly above a secondary combustion chamber 108. Refractory grates 110 separate the primary combustion chamber from the secondary combustion chamber. Although not shown in the same detail as in FIG. 1, each chamber includes an outer lining of heat insulation material and an inner lining of refractory material. A fuel feed opening 112 is located in the top of the primary combustion chamber and preferably includes a shallow open hopper 114 which is usually left open for the automatic feeding of fuel. The primary combustion chamber is also provided with a firing door 116 to enable the unit operator to hand feed fuel to the primary combustion chamber when necessary or desired and to allow the operator to start the fire. An air temperature control means 118 positioned on the outer front wall of the unit assists the operator in monitoring the unit so that the air supply necessary to support complete combustion may be maintained.

An ash clean-out door 120 is desirable to facilitate the removal of ash from the secondary combustion chamber 108 where it may interfere with the efficient operation of the unit if allowed to accumulate. An outlet 122 is provided in the secondary combustion chamber so that the hot combustion gases may flow into a conduit 124. Draft inducing means 126, the function of which will be explained in more detail hereinbelow, is positioned in conduit 124, preferably just downstream of the combustion unit. Conduit 124, which will typically extend a considerable distance away from combustion unit 100, is provided with an outlet 128 which communicates with a heat utilizing appliance 130.

The structure of the present combustion unit permits a two stage combustion process so that any fuel not fully combusted in the primary combustion chamber is maintained at a high enough temperature and provided with sufficient oxygen to achieve virtually complete combustion in the secondary chamber without the production of smoke. Moreover, the layers of insulating material in the combustion chamber walls in combination with the insulated outer shroud assure that a maximum amount of heat will be retained by the combustion gases, and that very little, if any, heat will be radiated from the combustion unit itself.

To achieve this result, a fire is built in the unit until a bed of coals is developed. In the embodiment of FIG. 3, all of the grates should be covered with coals, and the fuel, which is typically wood chips, corn cobs and the like, is then fed into the primary combustion chamber. The heat generated by the hot coals gasifies this feed stock, producing gases and smoke. The draft inducing means situated in the combustion gas conduit downstream of the combustion unit is activated and draws the gases and smoke through the hot coals and causes them to burn thoroughly. After approximately one hour following the start of combustion, the grates will become extremely hot and assist the coals in raising the temperature of the gases even higher. In the secondary combustion chamber just beyond the grates, the smoke and gases burn with a blue flame and the combustion products leaving the secondary combustion chamber outlet show virtually no trace of smoke. Temperatures monitored in the combustion gas conduit just downstream of the secondary combustion chamber and outlet typically range from about 800° F. to about 1200° F. and the products of combustion can be directed into a heat utilizing appliance, such as the air-to-air heat exchanger shown in FIG. 4, the tubing with reflectors to produce radiant heat shown in FIG. 5, or another type of heat-utilizing appliance such as a grain roaster or dryer. The heat utilizing appliances of FIGS. 4 and 5 will be installed to connect with conduit 70 of FIG. 1 or conduit 124 of FIG. 3.

Figure 4:
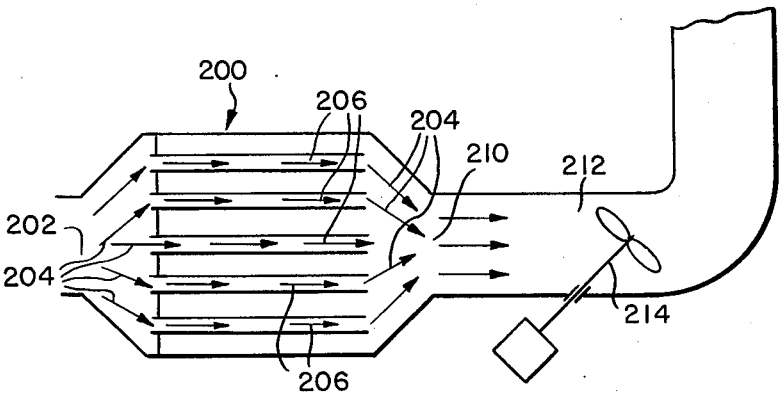
FIG. 4 is a schematic diagram of one type of heat utilizing appliance which may be installed in the conduit between the present combustion unit and the chimney.

FIG. 4 illustrates diagrammatically an air to air type of heat exchanger 200 which can be effectively utilized with the present combustion unit. The maximally heated combustion gases enter the heat exchanger at an inlet 202 and follow the paths depicted by arrows 204 through passages 206 where heat is transferred from the combustion gases to the air flowing through passages 208. The cooled combustion gases exit the exchanger 200 at an outlet 210 to flow into a conduit 212 which leads to a chimney (not shown). Draft inducing means 214 operates to keep a continuous positive flow of air through the combustion unit and, thus, combustion gases through the heat exchanger.

Figure 5:
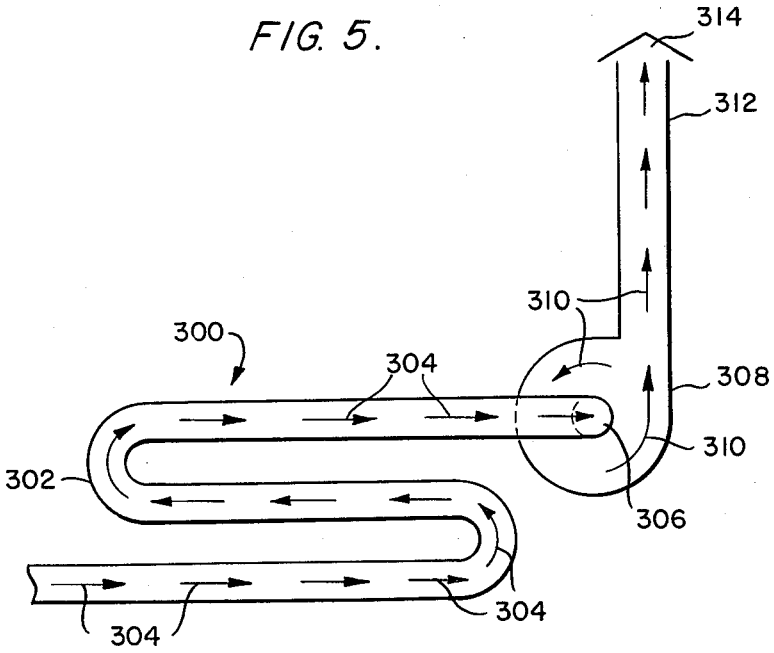
FIG. 5 is a schematic diagram of a second type of heat utilzing appliance which may be installed in the conduit between the present combustion unit and the chimney.

The heat utilizing appliance of FIG. 5 would most likely be employed to heat a home or a commercial building. This appliance 300 includes tubing 302 with reflectors (not shown) so that the heat from the hot combustion gases flowing through the tubing as indicated by arrows 304 radiates from the tubing into the space to be heated. An outlet 306 of tubing 302 communicates with draft inducing means 308. The heat exhausted combustion gases follow the path indicated by arrows 310 through draft inducing means 308 and exit through an outlet 314 of a chimney 312.

Other heat utilizing applicances, for example, grain dryers or roasters, can be efficiently utilized with the present combustion unit. Because the present combustion unit maximizes the heat produced from low grade inexpensive fuels, a feed processor could reduce operating expenses substantially by using a grain dryer or roaster with the present combustion unit which is fueled by corn cobs and other waste which would normally have to be disposed of. Additionally, other agricultural or industrial processors, particularly in locations where wood, wood chips and like fuels are readily and inexpensively available, could also recognize significant savings in operating costs by employing the present combustion unit.

INDUSTRIAL APPLICABILITY

The combustion unit of the present invention will find particular application when it is desired to provide relatively inexpensively a maximum amount of usable heat for use in carrying out agricultural and industrial processes and for heating interior residential or commercial spaces.

We claim:

1. A powered downdraft type combustion unit capable of producing a maximum amount of usable heat for application in end use devices remote from the combustion unit including an exterior outer shroud enclosing sequential combustion chambers, at least a primary interior combustion chamber and a secondary interior combustion chamber being defined within and spaced inwardly from said shroud, said primary combustion chamber being separated from said secondary combustion chamber by a plurality of refractory grates, said combustion unit further including primary and secondary air supply means, said primary air supply means being positioned to extend through said outer shroud into said primary combustion chamber, and said secondary air supply means being positioned to extend through said outer shroud into said secondary combustion chamber, said unit further including fuel feed means extending through said outer shroud into said primary combustion chamber and combustion gas outlet means extending from said secondary combustion chamber through said outer shroud, wherein said outer shroud is substantially a right angle parallelepiped in configuration having top, bottom, front, back and side walls and including a layer of heat insulating material immediately interior to and contiguous with each of said walls; the front to back dimension of said parallelepiped being substantially greater than the top to bottom dimension of said parallelepiped; said primary combustion chamber being disposed within said shroud toward the front wall thereof and spaced inwardly from said shroud front and top walls to create an insulating air space around said primary combustion chamber, and said secondary combustion chamber being disposed within said shroud and spaced inwardly from said shroud top and bottom walls to create an insulating air space completely around said secondary combustion chamber, said secondary combustion chamber extending from said primary combustion chamber to the back wall of said shroud, said fuel feed means being positioned in the top wall of said shroud, said combustion gas outlet means being positioned in the back wall of said shroud, said primary combustion chamber, said primary air supply means, said refractory grates, said secondary combustion chamber, said secondary air supply means and said combustion gas outlet means are all positioned in the same plane, said plane being parallel to the longest dimension of said shroud; and said primary combustion chamber and said secondary combustion chamber include insulated lining means for minimizing heat loss therefrom, said insulated lining means including at least two layers of heat insulating material.

2. The combustion unit described in claim 1, further including draft inducing means for maintaining a positive flow of air through said combustion unit.

3. The combustion unit described in claim 1, wherein said combustion gas outlet means is connected to heat exchange means for utilizing the heat contained in the combustion gases produced by said combustion unit.

4. The combustion unit described in claim 3, wherein the orientation of said primary combustion chamber relative to said combustion gas outlet means defines a flow path substantially coincident with the plane in which said primary and secondary combustion chambers, said primary and secondary air supply means, said refractory grates and said combustion gas outlet means are positioned.

5. The combustion unit described in claim 4, wherein said combustion unit is oriented so that said plane is horizontal.

6. The combustion unit described in claim 5, wherein said flow path is horizontal causing air and combustion gases to flow horizontally through said unit.

7. The combustion unit described in claim 4, wherein said draft inducing means is positioned downstream of said combustion gas outlet means.

* * * * *